US005519478A

United States Patent [19]

Malachowski

[11] Patent Number: 5,519,478

[45] Date of Patent: May 21, 1996

[54] FUSER NIP SHEET BASIS WEIGHT DETECTION SYSTEM

[75] Inventor: Michael A. Malachowski, Webster, N.Y.

[73] Assignee: Xerox Corporation, Stamford, Conn.

[21] Appl. No.: 352,961

[22] Filed: Nov. 25, 1994

[51] Int. Cl.[6] ..... G03G 15/20

[52] U.S. Cl. ..... 355/282; 355/308; 355/311

[58] Field of Search ..... 355/282, 308, 355/309, 311; 219/216; 432/60; 250/559, 571; 271/258, 262

[56] References Cited

U.S. PATENT DOCUMENTS 4,937,460 6/1990 Duncan et al. ..... 250/561
5,138,178 8/1992 Wong et al. ..... 250/559

*Primary Examiner*—William J. Royer
*Attorney, Agent, or Firm*—H. Fleischer; J. E. Beck; R. Zibelli

[57] ABSTRACT

An apparatus in which sheet basis weight is determined as a function of a change in angular velocity of a roller defining a nip through which the sheet passes. The sheet basis weight is calculated in response to the change in angular velocity of the roll before and after the sheet enters the nip. In an electrophotographic printing machine, the change in angular velocity of the fuser roll or pressure roll may be used to calculate the sheet basis weight.

18 Claims, 4 Drawing Sheets

FUSER NIP SHEET BASIS WEIGHT DETECTION SYSTEM

The present invention relates generally to copy sheet sensing in an electrophotographic printing machine, and more particularly concerns sensing basis weights of copy sheets entering a fusing station.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing developer material into contact therewith. This forms a powder image on the photoconductive member.

In the foregoing type of printing machine, the powder image formed on the photoconductive member is transferred from the photoconductive member to a copy sheet. The transferred powder image is typically only loosely applied to the copy sheet whereby, it is easily disturbed by the process of stripping the copy sheet from the photoconductive member and by the process of transporting the copy sheet to a fusing station. The copy sheet preferably passes through a fusing station as soon as possible after transfer to fuse the powder image permanently onto the copy sheet. Fusing permanently fixes the powder image to the sheet. One type of suitable fusing station is a roll-type fuser, wherein the copy sheet is passed through a pressure nip existing between two rolls, at least one of which is heated. A prefuser transport receives the copy sheet with the unfused image thereon from the photoconductive member and moves it to the fuser rolls.

Sheet basis weight sensing in an electrophotographic printing machine is desirable because it allows the range of paper weights processed by the printing machine to be increased. Job operability and completion can be affected by determining the basis weight of an existing paper supply. Work stations included in the printing machine that are sensitive to sheet basis weight can be maintained by adjusting appropriate parameters in accordance with the basis weight of sheets being processed. Since sheet basis weight bears a correlation to sheet thickness, image fusing can be improved by adjusting fuser drive motor speed according to sheet thickness. Development and transfer biases can be adjusted for optimal performance based upon sheet basis weight. Transport systems along the sheet path can be adjusted in accordance with sheet thickness. Registration accuracy and reliability, for example, in cross roll transfer systems can be improved. Sheet basis weight determination can improve finishing capabilities, such as stapling and book binding, which are influenced by sheet thickness. Adjustments to basis weight-sensitive work stations can also increase the life of machine components and reduce machine downtime resulting from jamming of improperly fed sheets.

Traditional methods used to determine basis weight or sheet thickness have used both contact and non-contact sensors. These arrangements require additional components that add increased cost, complexity, and size requirements to systems employing such thickness sensors. Furthermore, systems employing a contact type sensor have the disadvantage of requiring an element to engage the sheet wherein, the engaging element introduces the chance that the detecting system itself will influence the detected sheet thickness.

The following disclosures appear to contain relevant subject matter:

U.S. Pat. No. 4,937,460 Patentee: Duncan et al. Issued: Jun. 26, 1990

U.S. Pat. No. 5,138,178 Patentee: Wong et al. Issued: Aug. 11, 1992

The disclosures of the above-identified patents may be briefly summarized as follows:

U.S. Pat. No. 4,937,460 describes a optical sensor for detecting the thickness of a sheet moving over a stationary platen. The sensor relies on contact of the sheet by a pivotal lever mounted thereon. Light emitted from a source, in the sensor, is focused on a target mounted on the back of the lever. The light is angularly reflected back to a detector which is also in the sensor. The output of the detector provides a variable analog signal indicative of the sheet thickness.

U.S. Pat. No. 5,138,178 discloses a non-contact sensor utilizing an infrared light source and a transmissive detector mounted in a paper path. Since the amount of infrared energy transmitted through the paper is proportional to the thickness of the paper, the output of the detector is correlated to a thickness value of a sheet positioned in the detection zone of the sensor. Basis weight is determined in accordance with an idealized model to represent sensor output as a continuous function of paper thickness.

Pursuant to the features of the present invention, there is provided an apparatus for determining sheet basis weight. The apparatus includes: a rotatable member; a member positioned adjacent to the rotatable member to define therewith a nip through which the sheet passes; and a device operatively associated with the rotatable member. The device generates a measurement of the sheet basis weight as a function of a change in angular velocity of the rotatable member in response to the sheet entering the nip.

In accordance with another aspect of the present invention, there is provided an electrophotographic printing machine of the type having a processing station and in which sheet basis weight is determined. The improvement includes: a rotatable member; a member positioned adjacent to the rotatable member to define therewith a nip through which the sheet passes; and a device operatively associated with the rotatable member. The device generates a measurement of the sheet basis weight as a function of a change in angular velocity of the rotatable member in response to the sheet entering the nip.

In accordance with yet another aspect of the present invention, there is provided a method of detecting sheet basis weight of a copy sheet in a printing machine. The steps include: advancing a sheet to a nip defined by at least one rotating member; measuring a change in angular velocity of the rotating member in response to the sheet entering the nip; and calculating the sheet basis weight as a function of the change in angular velocity measured in the measuring step.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
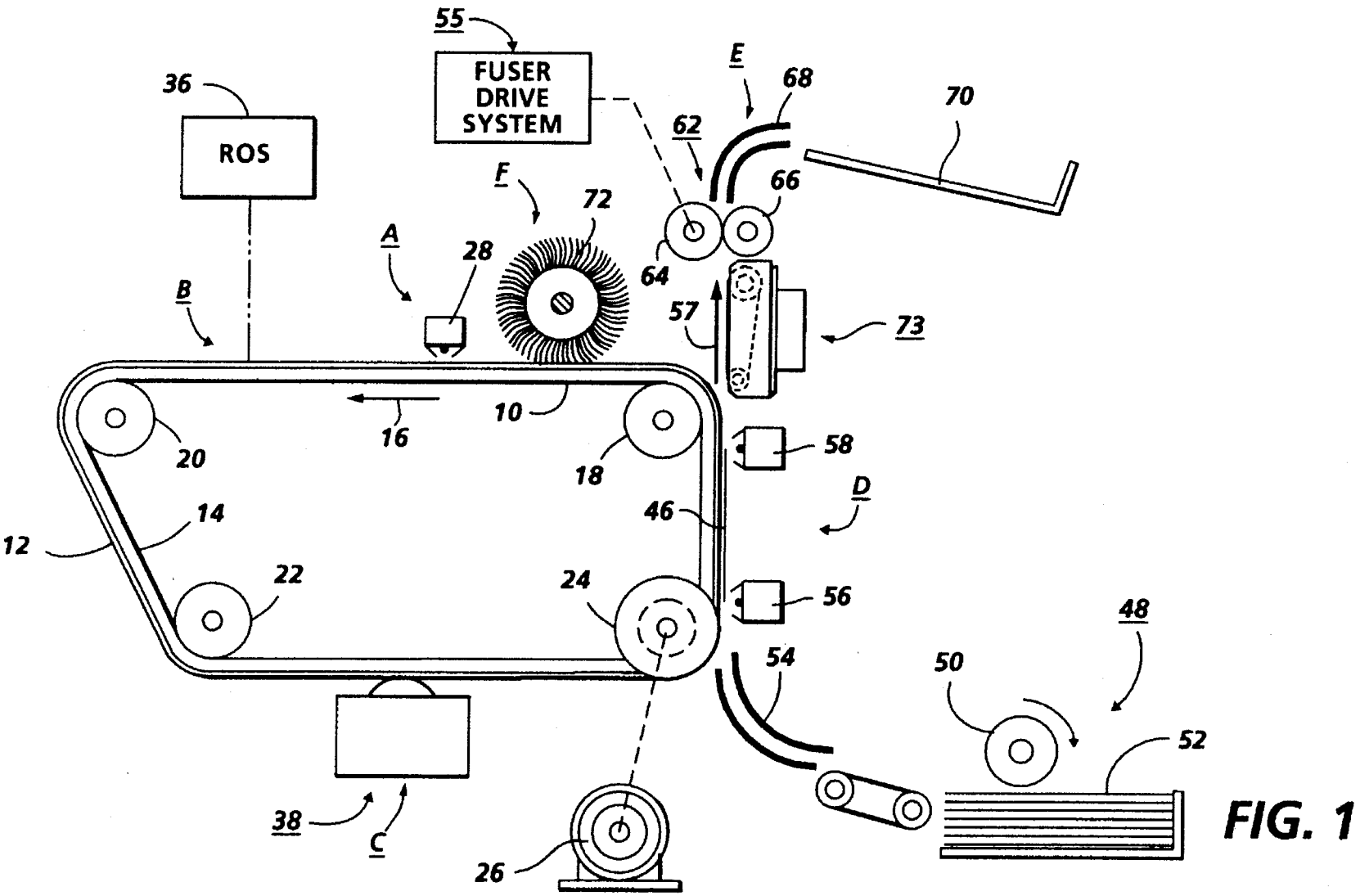
FIG. 1 is a schematic, elevational view depicting an illustrative-printing machine.

For a general understanding of the features of the present invention, reference is made to the drawings. In the drawings, like reference numerals have been used throughout to designate identical elements. FIG. 1 schematically depicts the various elements of an illustrative printing machine incorporating the fuser nip basis weight detection system of the present invention therein. It will become evident from the following discussion that the sheet basis weight detection system is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter and their operation described briefly with reference thereto.

Turning to FIG. 1, the printing machine employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22, 24. Roller 24 is coupled to motor 26 which drives roller 24 so as to advance belt 10 in the direction of arrow 16. The drive system comprising motor 26 is designed to drive the photoconductive belt 10 at a constant velocity.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, a Raster Input Scanner (RIS) and a Raster Output Scanner (ROS) are used instead of a light lens system. The RIS (not shown), contains document illumination lamps, optics, a mechanical scanning mechanism and photosensing elements such as charged couple device (CCD) arrays. The RIS captures the entire image from the original document and converts it to a series of raster scan lines. These raster scan lines are the output from the RIS and function as the input to a ROS 36 which performs the function of creating the output copy of the image and lays out the image in a series of horizontal lines with each line having a specific number of pixels per inch. These lines illuminate the charged portion of the photoconductive surface 12 to selectively discharge the charge thereon. An exemplary ROS 36 has lasers with rotating polygon mirror blocks, solid state modulator bars and mirrors. Still another type of exposure system would merely utilize a ROS 36. ROS 36 is controlled by the output from an electronic subsystem (ESS) which prepares and manages the image data flow between a computer and ROS 36. The ESS (not shown) is the control electronics for the ROS 36 and may be a self-contained, dedicated minicomputer. Thereafter, belt 10 advances the electrostatic latent image recorded on photoconductive surface 12 to development station C.

One skilled in the art will appreciate that a light lens system may be used instead of the RIS/ROS system heretofore described. An original document may be positioned face down upon a transparent platen. Lamps would flash light rays onto the original document. The light rays reflected from the original document are transmitted through a lens forming a light image thereof. The lens focuses the light image onto the charged portion of the photoconductive surface to selectively dissipate the charge thereon. This records an electrostatic latent image on the photoconductive surface which corresponds to the informational areas contained within the original document disposed upon the transparent platen.

At development station C, a magnetic brush developer system, indicated generally by the reference numeral 38, transports developer material comprising carrier granules having toner particles adhering triboelectrically thereto into contact with the electrostatic latent image recorded on photoconductive surface 12. Toner particles are attracted from the carrier granules to the latent image forming a powder image on the photoconductive surface 12 of belt 10. While dry developer material has been described, one skilled in the art will appreciate that a liquid developer material may be used in lieu thereof.

After development, belt 10 advances the toner powder image to an image transfer station D. At transfer station D, a sheet of support material comprising copy sheet 46 is moved into contact with the toner powder image. Copy sheet 46 is advanced to transfer station D by a sheet feeding apparatus, indicated generally by the reference numeral 48. Preferably, sheet feeding apparatus 48 includes a feed roll 50 contacting the uppermost sheet of a stack of sheets 52. Feed roll 50 rotates to advance the uppermost sheet from stack 52 into sheet chute 54. Chute 54 directs the advancing copy sheet 46 into contact with photoconductive surface 12 of belt 10 in a timed sequence so that the toner powder image developed thereon contacts the advancing copy sheet 46 at image transfer station D.

Image transfer station D includes a corona generating device 56 which applies electrostatic transfer charges to the backside of copy sheet 46 and electrostatically tacks copy sheet 46 against the photoconductive surface 12 of belt 10. The electrostatic transfer charges attracts the toner powder image from photoconductive surface 12 to copy sheet 46. After transfer, the lead edge of copy sheet 46 is transported on the photoconductive surface 12 under a detacking corona generator 58 which neutralizes most of the tacking charge thereon. However, it is not desirable to remove all of the transfer charges on the copy sheet 46, since that may reduce the electrostatic retention of the toner image to copy sheet 46. The detack charge, preferably applied with an alternating current corona emission is sufficient enough to allow copy sheet 46 to self strip from the photoconductive surface of belt 10.

After the lead edge of the copy sheet is stripped from the photoconductive surface of belt 10, it travels beneath a prefuser transport 73 in the direction of arrow 57. The prefuser transport 73 receives the copy sheet 46 with the unfused toner image thereon and advances it to fusing station E. Fusing station E is controlled by a fuser drive system 55. Fuser drive system 55 will be described herein after in greater detail, with reference to FIGS. 2 through 4.

Referring again to FIG. 1, fusing station E includes a fuser assembly, indicated generally by the reference numeral 62, which permanently affixes the toner powder image to copy sheet 46. Preferably, fuser assembly 62 includes a heated fuser roll 64 and a back-up roll 66. Sheet 46 passes between fuser roller 64 and back-up roll 66 with the toner powder image contacting fuser roll 64. In this manner, the toner powder image is permanently affixed to copy sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. One skilled in the art will appreciate that other cleaning means may be used such as a blade cleaner. Subsequent to cleaning, a discharge lamp (not shown) floods photoconductive surface 12 with light to dissipate any residual charge remaining thereon prior to the charging thereof for the next successive imaging cycle.

While the sheet basis weight detection system is disclosed in a preferred embodiment when a sheet enters a fuser nip, it should be understood that it could be used in any situation where nip sensing is desired. For example, in sheet transport systems, wherein roll nips are used instead of belts, or wherein one roll and a belt or other planar member is used.

Figure 2:
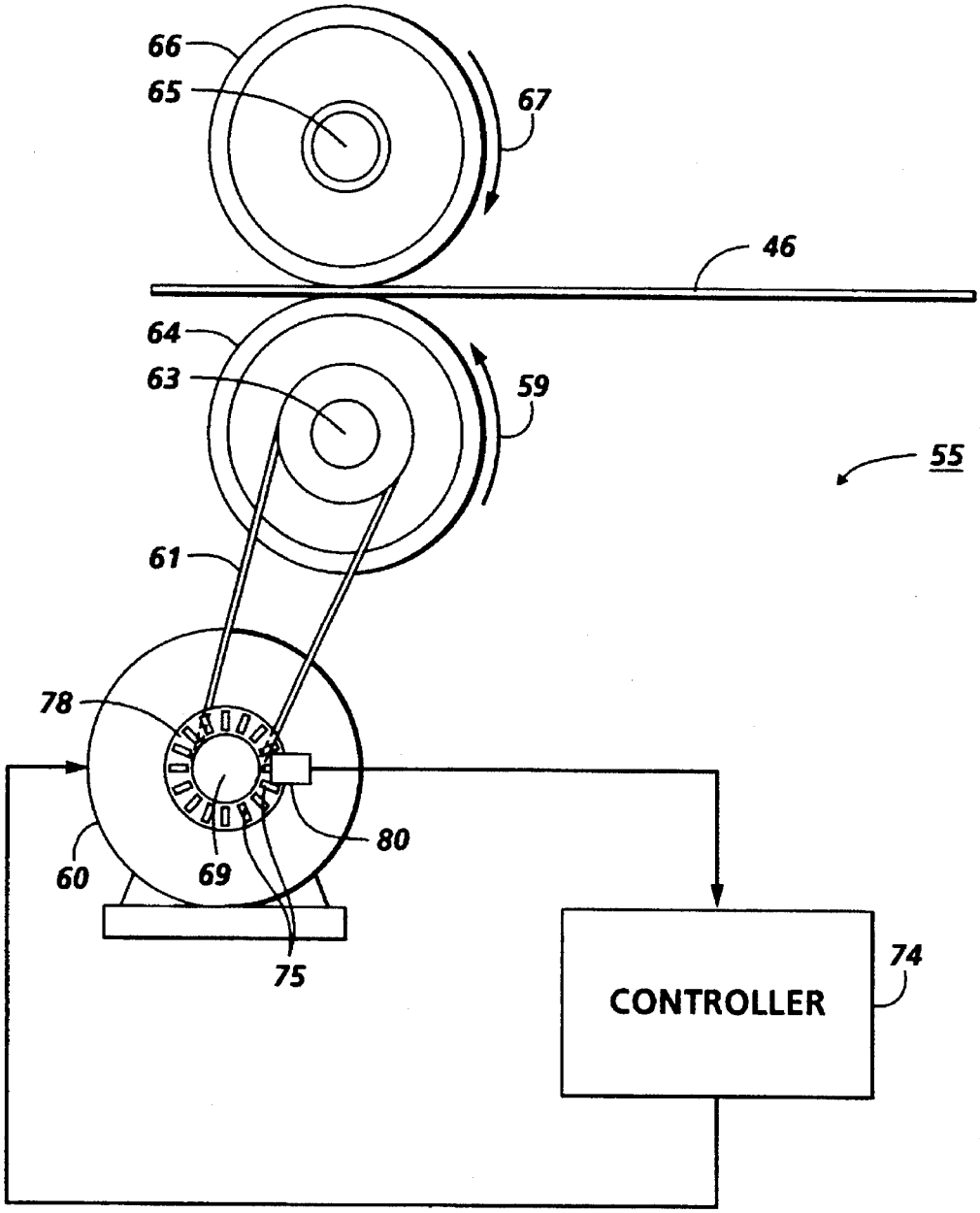
FIG. 2 is a schematic, elevational view showing a control system for determining paper basis weight in the FIG. 1 printing machine.

Turning now to FIG. 2, the drive system for fusing station E includes motor 60, disk 78, sensor 80, and controller 74. Fuser roll 64 is mounted for rotation on shaft 63. It rotates in the direction of arrow 59. Pressure roll 66 is rotated in the direction of arrow 67 by movement of shaft 65. Shaft 63 is connected to motor 60 by belt 61 which is rotatably mounted on shaft 69. Disk 78 is secured fixedly to shaft 69 so that disk 78 rotates in unison with shaft 69. Disk 78 and sensor 80 are particularly adapted for use in a digital output displacement transducer commonly referred to as a "shaft encoder". The disk 78 comprises a set of transparent marks 75 arranged on a common track about its center. A single transparent reference mark (not shown) is disposed intermediate of marks 75 and the center of disk 78. Sensor 80 is a photoelectric device, in which the reading head consists of a light-source assembly (not shown) on one side of disk 78 and a light-receiver assembly (not shown) facing the light-source assembly on the other side of disk 78. Operating together, disk 78 and sensor 80 provide a series of simple, alternating "on" and "off" pulses in the form of a coded pattern. As disk 78 rotates in unison with shaft 69, the shaft encoder generates an output signal indicative of the speed of motor 60. The signal is in the form of number of pulses or counts generated in each revolution of shaft 69. Accordingly, a period between the beginning and the end of each revolution is signified by respective index pulses generated by the reference mark on disk 78.

The output signal generated by the shaft encoder is communicated to controller 74. Controller 74 can comprise a microcomputer including a Central Processing Unit (CPU), Read Only Memory (ROM), Random Access Memory (RAM), and Input/Output (I/O) devices for interfacing to an external device, such as motor 60. Ideally, the controller 74 can be implemented in a general purpose microprocessor, which is typically used for controlling machine operations in an electrophotographic printing machine. As shown in FIG. 2, controller 64 is adapted to receive signals from the shaft encoder when copy sheet 46 enters the fuser nip. Pulses from the shaft encoder can be stored in RAM and a motor speed value can be derived in the CPU according to information stored in ROM. The speed of motor 60 can be varied by the I/O to ensure for proper fusing of copy sheet 46 having an unfused image thereon.

Sheet basis weight can be measured using the existing components illustrated in FIG. 2. Referring again to FIG. 2, the technique relies on measuring the change in angular velocity of the fuser or pressure rolls, or the speed change of motor 60 as the lead edge of copy sheet 46 advances into the fuser nip defined by fuser roll 64 and pressure roll 66.

Figure 3:
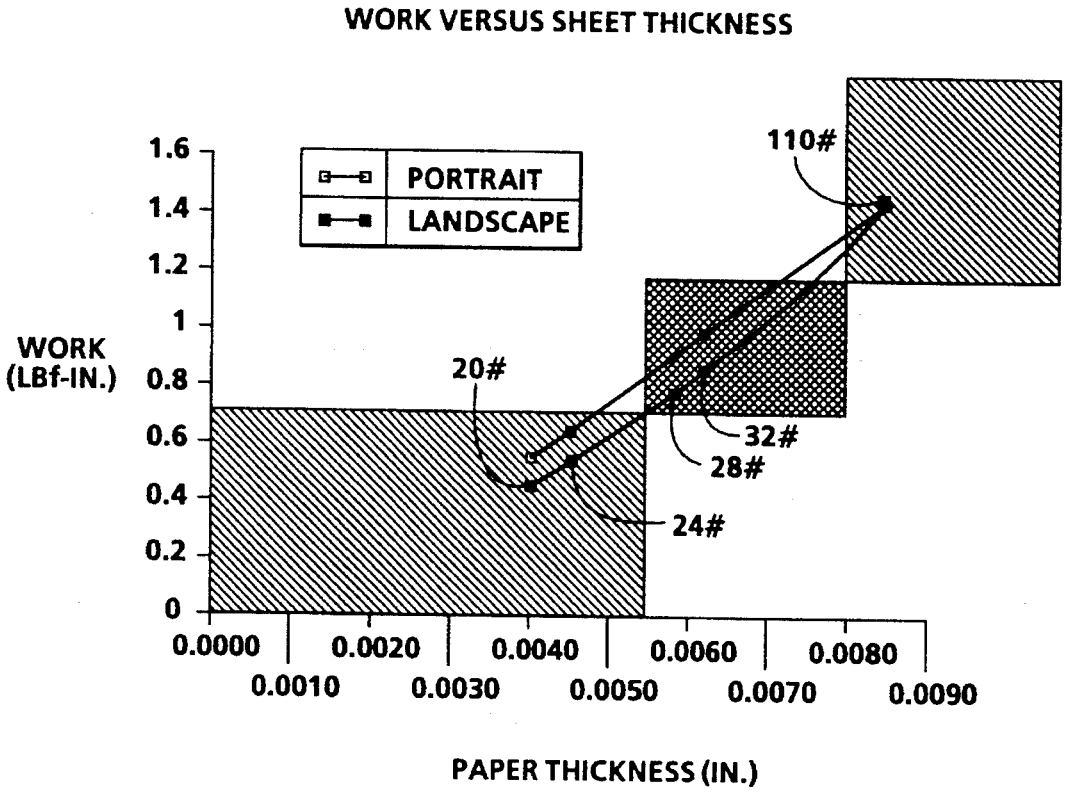
FIG. 3 is a plot of fuser nip insertion work required for various values of sheet thickness and width.

Referring to FIG. 3, a clear relationship is shown to exist between the work required to advance a sheet through the fuser nip and various sheet widths and thicknesses. Two "Work Versus Sheet Thickness" plots are shown in FIG. 3. One plot represents data for portrait wide sheets inserted into the fuser nip, while the other represents data for landscape wide sheets. Both plots are further divided into three basis weight groups comprising: a light weight zone, a medium weight zone, and a heavy weight zone. The lightweight zone includes 20# and 24# sheets, along with all sheet thicknesses less than 0.0055 inches. The medium weight zone includes 28# and 32# sheets, along with all sheet thicknesses greater than 0.0055 inches, but less than 0.0080 inches. The heavy weight zone includes 110# sheets, and all sheet thicknesses greater than 0.0080 inches. In the case of light weight sheets, for example, such as 20# portrait sheet, the work is approximately 0.44 $LB_f$-IN. Subtracting the work (W) from the fuser motor's initial kinetic energy ($KE_i$) of 42.48 $LB_f$-IN, the final kinetic energy ($KE_f$) will be 42.04 $LB_f$-IN where, $$KE_f = KE_i - W$$

and, $$KE_i = \tfrac{1}{2}(M/g \times Vo_i^2)$$

where:

$KE_i$=initial kinetic energy of the motor in $LB_f$-IN,

M=mass in LBm, g=a gravitational constant of 386 in/sec$^2$, and $Vo_i$=motor velocity in in/sec.

The final value of kinetic energy ($KE_f$) results in a final motor velocity ($Vo_f$) of 7.286 in/sec and a speed reduction of 0.48% where, $$Vo_f = (2KE_f g/M)^{1/2}$$

and, $$\text{percent speed reduction} = [(KE_i - KE_f) \div KE_i] \times 100$$

In a similar manner, the swallowing work for a 110# portrait sheet is approximately 1.5 $LB_f$-IN. The final motor velocity ($Vo_f$) is 7.184 in/sec. with a 1.8% speed reduction.

Figure 4:
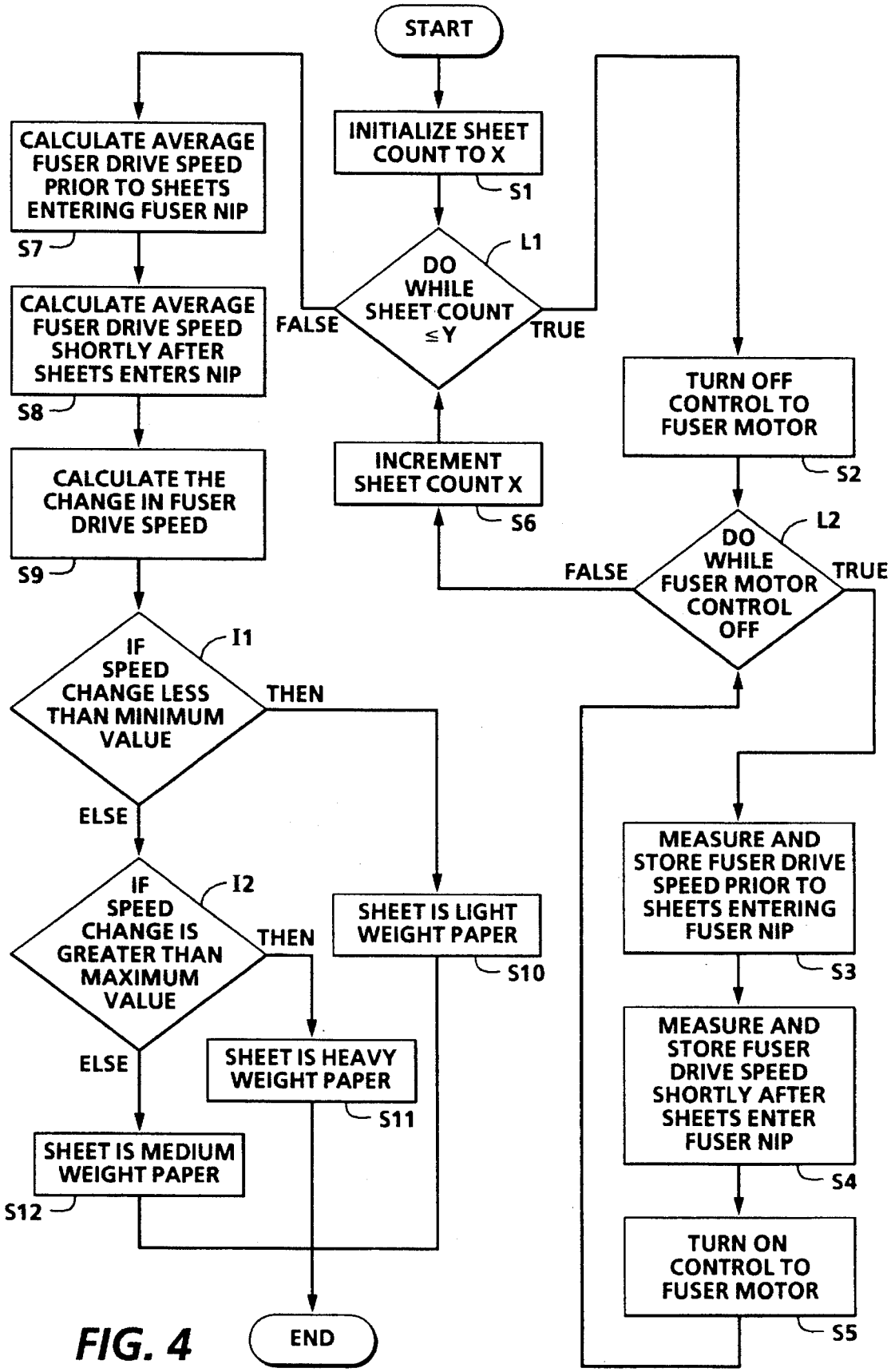
FIG. 4 is a flow diagram of the FIG. 2 control system in accordance with the present invention.

In FIG. 4, there is shown a flow diagram illustrating a routine for making sheet basis weight determinations to control fusing operations. The determination of sheet basis weight can be accomplished using the existing components illustrated in FIG. 2. The technique relies on measuring the speed change of motor 60 as the lead edge of copy sheet 46 advances into the fuser nip. The routine can be implemented by the general purpose microcomputer previously discussed. For purposes of description, it will be assumed that the changes in motor speed values necessary to correlate sheet basis weight to nip insertion work have been entered and stored in the microprocessor. Accordingly, the data resides in the ROM and is in the form of a look-up table.

Referring now to FIG. 4 at step S1, a start value X is set as an initial value for the number of sheets to be fed from the sheet feeding apparatus previously described with reference to FIG. 1. The condition is made after the start of the routine to initialize a sheet feed count that tracks the sheet sample size being used to determine basis weight. The routine proceeds to a first loop of repetitive execution at loop L1. While in loop L1, the routine inspects the value of a predetermined sheet sample size Y. If the current sheet count X is less than Y, the routine executes step S2. At step S2, the routine turns off the control to the fuser motor before the sheet enters the fuser nip and continues on to a second loop of repetitive execution at loop L2. Ideally, the fuser motor speed remains constant in the absence of any drag or additional required work at step S2.

In the second loop identified as L2, the routine inspects for the condition that the fuser motor control is turned off. If the condition is true, the routine performs the functions of steps S3, S4, and S5. At step S3, the routine measures the fuser motor speed just prior to the sheet entering the fuser nip and temporarily stores the data at a location in RAM. Shortly after the sheet enters the nip, by approximately 10 to 15 millimeters of swallow, the routine measures the fuser motor speed again at step S4. The data collected at step S4 is temporarily stored at another location in RAM. At step S5, the routine reenergize the fuser motor control. The routine then returns to loop L2 to reinspect for the condition that the fuser motor control is turned off. If the condition is false, the routine leaves loop L2 and proceeds to step S6. At step S6, the routine increments the value of X for the sheet feed count and returns to loop L1 to reinspect for the condition that the sheet count X is less than or equal to the predetermined sheet sample size Y. If the condition is still true, the routine repeats its processing through loops L1 and L2 until the value of sheet count X exceeds the predetermined sheet sample size Y.

Once the value of sheet count X exceeds the predetermined sheet sample size Y, the routine terminates loop 1 and respectively executes steps S7 and S8. It is likely that the plurality of raw data taken at steps S3 and S4 include a significant amount of noise induced by the fuser motor drive system. Thus, the raw data is filtered to remove the noise. To do so, a suitable subroutine is invoked by the microprocessor to calculate average values for the raw data collected at steps S3 and S4. Step S7 accesses an array of RAM locations wherein, the motor speed data previously taken prior to nip entry is temporarily stored. Repeated execution through the memory array accumulates a sum that is used to compute the average value. The new average value for fuser drive speed prior to sheets entering the fuser nip is then temporarily stored in RAM until further use at step S9. In an identical manner, step S8 calculates the average fuser drive speed shortly after sheets enter the fuser nip and temporarily stores that value in RAM until required by step S9. At step S9, the routine calculates the change in fuser drive speed by performing a subtraction on the values obtained in steps S7 and S8.

The routine then proceeds on to execute a plurality of conditions, which permit a decision concerning the sheet basis weight. As described previously, changes in motor speed values have been stored in a look-up table which resides in the ROM of the implementing microprocessor. Therefore at a first condition 11, the routine compares the calculated value of fuser drive speed to the the minimum value stored in the look-up table. If the condition is true, such that the calculated value is less than a minimum value stored in the look-up table then, the routine concludes that the sheet is light weight paper S10. However, if condition 11 is false, the routine continues on to a second condition 12. At 12, the routine then compares the calculated value of the fuser drive speed to a maximum value stored in the look-up table. If this condition is true, such that the calculated value is greater than the maximum value stored in memory then, the routine concludes that the sheet is heavy weight paper S11. If condition 12 is false, the routine concludes by default, that the sheet is of medium weight paper S12.

One skilled in the art will appreciate that rather than measuring the motor speed, the angular velocity of the fuser roll or pressure roll may be measured directly with an encoder. The change in angular velocity produced by the sheet entering the fuser nip is a measurement of the sheet basis weight or thickness. Furthermore, one skilled in the art will appreciate that any nip having at least one roller through which the sheet passes may be used to determine sheet basis weight.

In recapitulation, it is clear that the present invention permits a determination of sheet basis weight or thickness. The changes in motor speed or roll angular velocity are used to determine sheet basis weight. Motor speed or roll angular velocity is measured prior to the sheet entering the fuser nip. Shortly after the sheet enters the nip, the motor speed or roll angular velocity is measured again. If the difference between the two measurements is less a first predetermined value, the sheet is determined to be of a low basis weight. If the change is greater than a second predetermined value, the sheet is determined to be of a high basis weight. A change in motor speed or roll angular velocity intermediate the two predetermined values is indicative of medium weight sheets.

It is, therefore, evident that there has been provided, in accordance with the present invention, a fuser nip sheet basis weight detection system that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations as are within the broad scope and spirit of the appended claims.

I claim:

1. An apparatus for determining sheet basis weight, including:

a rotatable member;

a member positioned adjacent said rotatable member to define therewith a nip through which the sheet passes; and a device, operatively associated with said rotatable member, for generating a measurement of the sheet basis weight as a function of a change in angular velocity of said rotatable member in response to the sheet entering the nip.

2. An apparatus according to claim 1, wherein said device includes:

a sensor, associated with said rotatable member, for detecting the angular velocity of said rotatable member; and a processing unit, in communication with said sensor, for calculating the sheet basis weight as a function of the change in angular velocity of said rotatable member detected by said sensor in response to the sheet entering the nip.

3. An apparatus according to claim 2, further including a motor coupled to said rotatable member, for rotating said rotatable member, said sensor detecting a change in speed of said motor and generating a signal indicative thereof.

4. An apparatus according to claim 3, wherein said member includes a second rotatable member.

5. An apparatus according to claim 4, further including a controller, associated with said sensor, for maintaining said motor at a selected speed in response to the signal from said sensor.

6. An apparatus according to claim 5, wherein said sensor includes a shaft encoder.

7. An electrophotographic printing machine of the type having a processing station and in which sheet basis weight is determined, wherein the improvement includes:

a rotatable member;

a member positioned adjacent said rotatable member to define therewith a nip through which the sheet passes; and a device, operatively associated with said rotatable member, for generating a measurement of the sheet basis weight as a function of a change in angular velocity of said rotatable member in response to the sheet entering the nip.

8. A printing machine according to claim 7, wherein said device includes:

a sensor, associated with said rotatable member, for detecting the angular velocity of said rotatable member; and a processing unit, in communication with said sensor, for calculating the sheet basis weight as a function of the change in angular velocity of said rotatable member detected by said sensor in response to the sheet entering the nip.

9. A printing machine according to claim 8, further including a motor coupled to said rotatable member, for rotating said rotatable member, said sensor detecting a change in speed of said motor and generating a signal indicative thereof.

10. A printing machine according to claim 9, wherein said member includes a second rotatable member.

11. A printing machine according to claim 10, wherein:

said first mentioned rotatable member includes a fuser roll; and said second rotatable member includes a pressure roll.

12. A printing machine according to claim 10, further including a controller, associated with said sensor, for maintaining said motor at a selected speed in response to the signal from said sensor.

13. A printing machine according to claim 12, wherein said sensor includes a shaft encoder.

14. A printing machine according to claim 12, wherein said controller regulates the processing station as a function of the signal received from said sensor.

15. A method of detecting sheet basis weight of a copy sheet in a printing machine, including:

advancing a sheet to a nip defined by at least one rotating member;

measuring a change in angular velocity of the rotating member in response to the sheet entering the nip; and calculating the sheet basis weight as a function of the change in angular velocity measured in said measuring step.

16. A method according to claim 15, wherein said measuring step includes detecting a change in speed of a motor driving the rotating member.

17. A method according to claim 16, further including controlling the motor to maintain a selected speed in response to said detecting step detecting the change in speed of the motor.

18. A method according to claim 17, wherein said controlling step regulates a processing station in the printing machine in response to said detecting step detecting the change in speed of the motor.

* * * * *